United States Patent [19]

Smith et al.

[11] Patent Number: 4,487,292

[45] Date of Patent: Dec. 11, 1984

[54] LET DOWN APPARATUS

[75] Inventors: Franklin G. Smith; David L. Prevost, both of Portland, Oreg.

[73] Assignee: LeRoy G. Haagen, Vancouver, Wash.

[21] Appl. No.: 386,993

[22] Filed: Jun. 10, 1982

[51] Int. Cl.[3] ..... A62B 1/10

[52] U.S. Cl. ..... 182/234; 182/239

[58] Field of Search ..... 182/234, 239, 236, 237, 182/238, 240, 71, 72, 73, 75, 231, 232, 235, 5, 4, 9; 242/99, 107.3; 254/378; 188/185, 64

[56] References Cited

U.S. PATENT DOCUMENTS

| | | | |
|---|---|---|---|
| 941,722 | 11/1909 | Moulton | 182/236 |
| 1,551,929 | 9/1925 | Bryan | 188/327 |
| 2,122,315 | 6/1938 | Fosty | 182/239 |
| 2,481,638 | 9/1949 | Borup | 242/107.3 |
| 2,761,650 | 9/1956 | Faugier | 242/107.3 |
| 3,188,052 | 6/1965 | Longworth | 248/234 |

FOREIGN PATENT DOCUMENTS

| | | | |
|---|---|---|---|
| 1049992 | 6/1979 | Canada | 242/99 |
| 79875 | 2/1895 | Fed. Rep. of Germany | 182/73 |
| 298093 | 8/1919 | Fed. Rep. of Germany | 242/99 |
| 450493 | 10/1927 | Fed. Rep. of Germany | 182/73 |

*Primary Examiner*—Reinaldo P. Machado
*Assistant Examiner*—Alvin Chin-Shue
*Attorney, Agent, or Firm*—Klarquist, Sparkman, Campbell, Leigh & Whinston

[57] ABSTRACT

An apparatus is provided for letting a person down from a substantial height. The invention includes: a rotatably mounted reel for retaining an elongate extension member adapted to be connected to the person to be let down; a brake for reducing the rate of rotation of the reel, the brake including a brake drum and a pair of brake shoes mounted to rotate with the reel; a governor including a pair of radially inwardly articulated flyweights extending between the brake shoes, the articulation permitting the flyweights to be displaced radially outwardly as the rate of rotation of the brake shoes and the reel increase, to displace the brake shoes radially outwardly whereby the pressure of the brake shoes against the brake drum and the resulting brake is increased as the rate of rotation of the reel increases; and a crank mounted to the apparatus for permitting the reel to be rewound onto the reel.

11 Claims, 6 Drawing Figures

6
6
210
296
300
298
222
294
302
219
82
10
50
55a
54a
62a
62b
56a
60b
60a
62a
20
62b
46
56b
77b
79
54b
55b
80
40
42
76b
78b
67
14
72
68
74
64
30
32
66
70
19
23

LET DOWN APPARATUS

BACKGROUND OF THE INVENTION

1. Field of the Invention

The invention relates to an apparatus for safely lowering a person from an elevated position, such as a high-rise building.

2. Discussion of the Prior Art

A serious need has existed for many years for an apparatus which permits a person to be safely lowered from a substantial height. This need has become increasingly acute as the height of buildings has come to exceed the maximum reach of extension ladders. The only safe means now commonly used for removing people from the upper floors of modern high-rise buildings is with the use of helicopters, which is slow, difficult, expensive and is often impossible due to the lack of sufficient landing space on the roofs of such buildings.

Various designs have been developed over the years which might have some applicability to lowering a person from a substantial height. One such prior art apparatus is marketed under the designation "Rescumatic" and includes a toothed pulley with a coaxially mounted braking system including a pair of radially offset brake shoes with radially inwardly articulated flyweights disposed therebetween. As the rate of rotation of the pulley increases (resulting from an increase in the rate of descent of a person holding on to one end of the rope), the flyweights tend to be displaced outwardly, thereby increasing the force of the brake shoes against a stationary brake drum to provide additional braking. However, because the Rescumatic is only a pulley, there is always a downwardly extending free end of rope which is susceptible to becoming hung up, causing the descending person to jerk to an abrupt stop. This would obviously present a serious danger. Moreover, the free end is going to be subjected to heat if the apparatus is being used during a fire, thereby preventing the possibility of resulting degradation of the rope. This degradation is a serious drawback because it could cause slippage through or tearing by the pulley teeth, presenting further possibility of catastrophic failure of the apparatus.

Another prior art apparatus is disclosed in U.S. Pat. No. 3,602,483 to Russell et al. This patent discloses a reel-type apparatus utilizing a metal ribbon which is unwound as the device lowers the person to the ground. The device has a reel section and a coaxial brake section. The brake section includes four pivotally and rotationally mounted brake shoes which are exerted outwardly against a stationary brake drum by leaf springs. When the reel is rotated and the ribbon is let out, the pivotal action of the brake shoes increases braking as the rate of rotation of the reel increases. This increase in braking is intended to slow the reel speed to maintain descent at a relatively slow, regular rate.

While the Russell apparatus appears to have some advantages, there are several serious drawbacks. First Russell's apparatus travels downwardly which the person as he is being lowered. The two primary disadvantages which such construction are (1) that it necessarily adds to the weight which is traveling downwardly, thereby increasing the downward momentum, and (2) that it makes rewinding more difficult than if the device is stationarily mounted. Another drawback of Russell's design is that despite the pivotal mounting of the brake shoes, it is unlikely that there would be a substantial increase in brake pressure as the speed of rotation increases, thus making it possible that the rate of descent would increase as the person is being lowered to the ground.

Other patents disclose the desirability of utilizing flyweights to increase brake pressure as the rate of rotation of a reel-type device increases; see, e.g., U.S. Pat. Nos. 1,888,911 to Graffenreid; 1,888,327 to Rosland; 1,593,704 to Morris; 1,308,480 to Caouette; and 425,554 to Stiver et al. Of these patents, Graffenreid is perhaps the most pertinent because it discloses the desirability of incorporating flyweights into a let down apparatus braking system, thereby increasing the proportional variation of the brake pressure as the rate of reel rotation changes. The Stiver et al patent also discloses the desirability of a crank to manually rewind the apparatus for reuse by another person.

Despite the existence of these prior art designs, no one has yet developed an effective system for safely and inexpensively lowering a person from a substantial height.

Hence, it is a primary object of the present invention to provide an improved let down device which effectively and reliably overcomes the aforementioned limitations and drawbacks of the prior art proposals. More specifically, the present invention has as its objects one or more of the following taken individually or in combination:

(1) The provision of an apparatus for lowering persons safely and slowly from a substantial height regardless of the weight of the individual and the height from which the person is being lowered;

(2) The development of a let down apparatus which is simple in construction and therefore inexpensive, and which is compact and therefore portable;

(3) To provide a let down apparatus which includes a manual rewind feature which facilitates relatively fast rewind even by those with minimal physical capabilities;

(4) The provision of a let down apparatus in which the rate of descent slows as the person approaches the ground;

(5) To develop a let down apparatus which permits the user to enter a harness or chair adjacent the apparatus without being lowered until the user is ready;

(6) To provide a let down apparatus which is easily maintained, particularly with respect to the brake portion; and (7) The development of a let down apparatus in which heat will have little or no effect upon operating characteristics.

SUMMARY OF THE INVENTION

This invention responds to the problems presented in the prior art by providing an apparatus for letting a person down from a substantial height which includes the following components: (1) rotatably mounted reel means for retaining an elongate extension member adapted to be connected to the person to be let down; (2) brake means for reducing the rate of rotation of the reel means, the brake means including a brake drum and a pair of radially opposed brake shoes, the brake shoes being mounted to rotate with the rotation of the reel means; (3) governor means including a pair of radially inwardly articulated flyweights extending between the brake shoes, the articulation permitting the flyweights to be displaced radially outwardly as the rate of rotation of the brake shoes and the reel means increase to displace the brake shoes radially outwardly, whereby the pressure of the brake shoes against the brake drum and the resulting braking is increased as the rate of rotation of the reel means increases; and (4) crank means mounted to the apparatus for manually rewinding the reel means. The crank means may be mounted to either the reel means or the brake means, depending upon whether speed or ease of rewind is the primary concern during rewinding operations. The invention thus provides an apparatus which is well suited for lowering persons safely and slowly from a substantial height regardless of the weight of the individual and the height from which the person is being lowered. The invention is also simple in construction and therefore inexpensive, compact, and easy to maintain.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
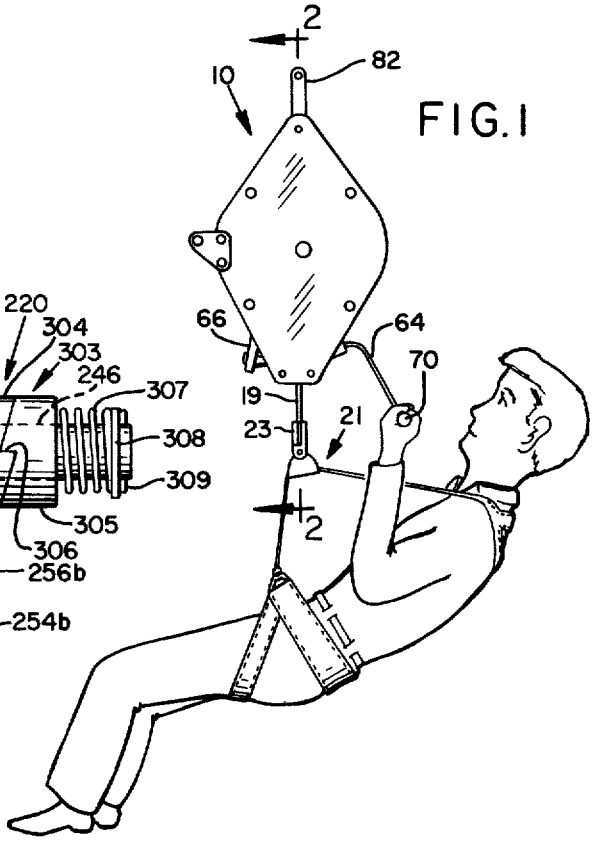
FIG. 1 is a side elevation view of a first embodiment of the invention showing the user in position ready to initiate let down.
Figure 2:
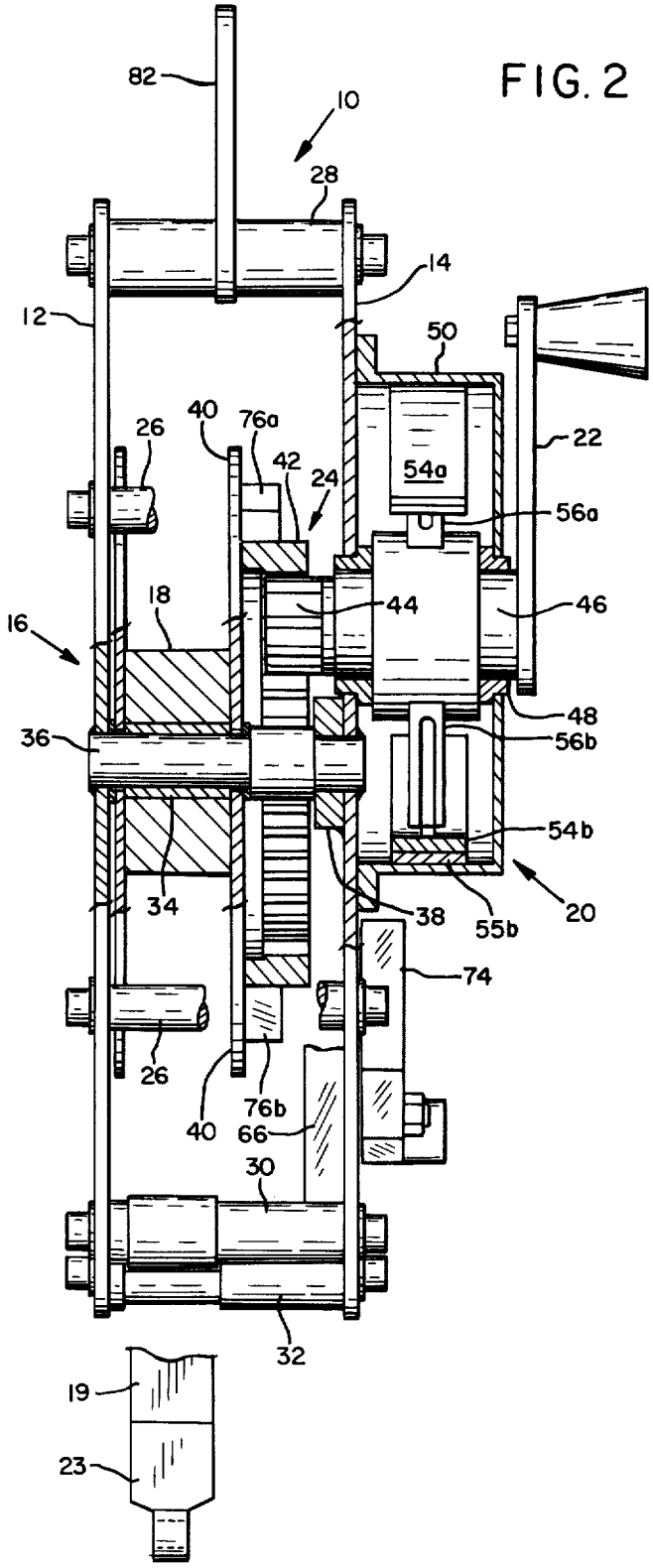
FIG. 2 is a sectional view taken along line 2—2 of FIG. 1.
Figures 3, 5:
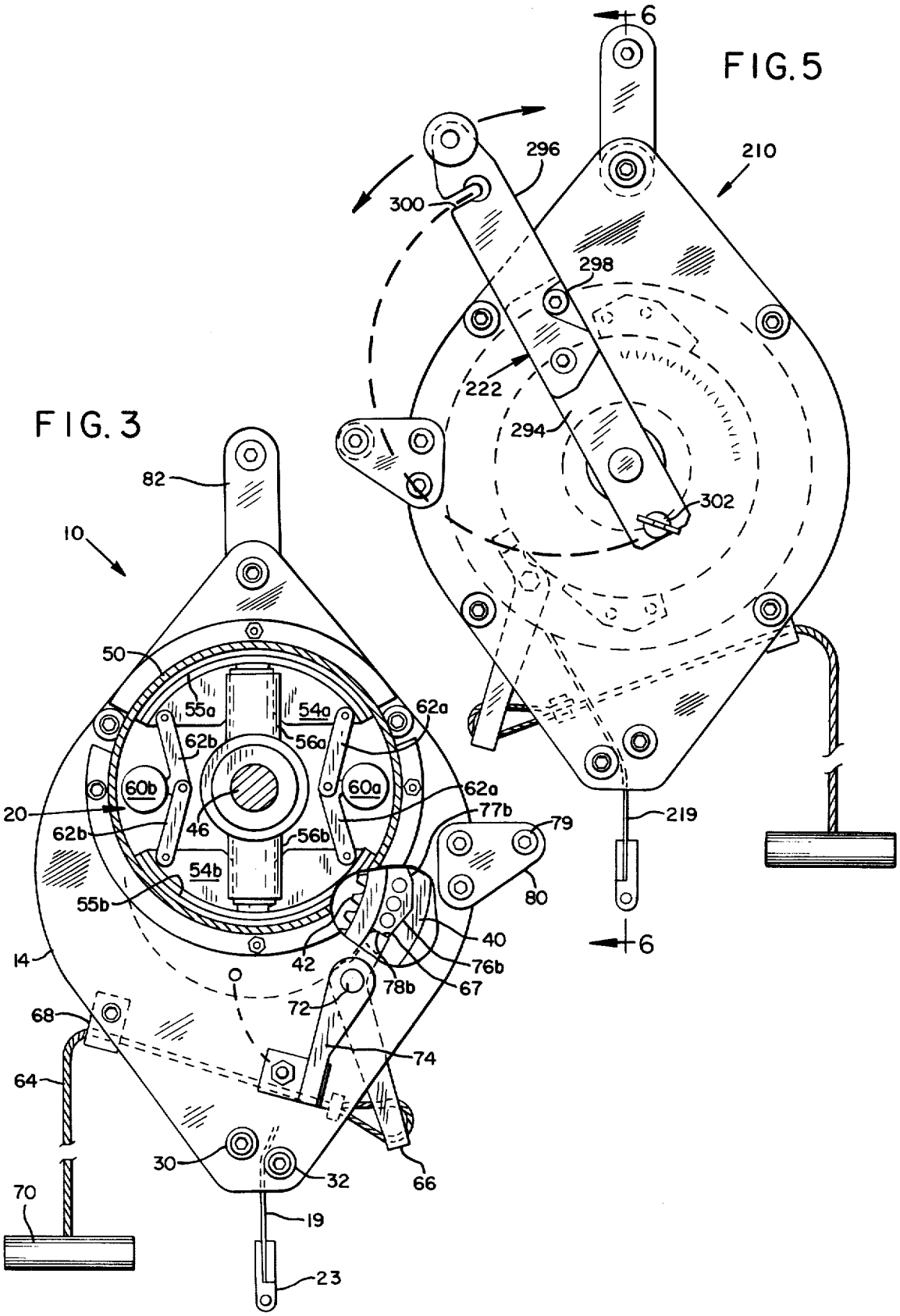
FIG. 3 is a partially cut away, side elevation view of the embodiment of FIGS. 1 and 2.
FIG. 5 is a side elevation view of another embodiment of the invention.

Embodiment of FIGS. 1-3

In that form of the invention chosen for purposes of illustration in FIGS. 1-3, the let down apparatus has been generally indicated with the numeral 10. The apparatus 10 includes a pair of parallel side plates 12 and 14 which encompass a reel structure 16 including a rotatably mounted spool 18. Strapping 19 is typically utilized with spool 18, but any other suitable elongate extension means such as cable may alternatively be used. As depicted, strapping 19 is mounted to a conventional harness 21 by a harness mounting clip 23. Mounted to side plate 14 is a governor and brake structure 20 which controls the rate of rotation of spool 18. A rewind crank arm 22 is mounted to governor and brake structure 20 and, through appropriate gear means 24, is drivingly connected to spool 18 to permit the spool to be manually rewound once the person has been lowered to the ground.

More particularly, side plates 12 and 14 are mounted with respect to each other by four peripheral spacers 26, a hanger spacer 28, and a pair of strap guides 30 and 32. Spool 18 is rotatably mounted via a spool bushing 34 to a spool shaft 36, the spool shaft being welded to side plates 12 and 14. A spool shaft support 38 is fixed to side plate 14 to provide additional support to spool shaft 36. This design permits spool 18 to rotate freely with respect to side plates 12 and 14. Spool 18 includes means such as a slot (not shown) for retaining one end of strapping 19 in the spool.

A substantially circular disc 40 is mounted to spool 18 to rotate therewith. An internal spur gear or ring gear 42 is mounted to the side of disc 40 which is facing away from spool 18. A spur pinion 44 meshes with ring gear 42 to transmit rotation from spool 18 to governor and brake structure 20. Spur pinion 44 is mounted to one end of a governor drive shaft 46 which is rotatably mounted within a governor shaft bushing 48. Governor shaft bushing 48 is fixed to a brake drum 50 which is stationarily mounted to side plate 14 by bolts (not shown) or the like. This makes brake drum 50 accessible for adjustment, repair, or replacement.

The governor and brake structure 20 is best depicted in FIG. 3. Brake drum 50 is frictionally engaged by a pair of opposed brake shoes 54*a* and *b* having brake pads 55*a* and *b*, respectively. Brake shoes 54*a* and *b* are engaged by a pair of radius arms 56*a* and *b* which mount the brake shoes for rotation with governor drive shaft 46, yet permit the brake shoes to slide inwardly and outwardly in a radial direction to permit the amount of braking to be varied.

A pair of radially opposed flyweights 60*a* and *b* are disposed between brake shoes 54*a* and *b* on articulated link arms 62*a* and *b*. The articulation of link arms 62*a* and *b* is such that as the rate of rotation of governor drive shaft 46 increases, flyweights 60*a* and *b* are permitted to move outwardly, thereby increasing the pressure of brake shoes 54*a* and *b* against brake drum 50 to increase braking and thereby reduce the rate of rotation of governor drive shaft 46 and spool 18 drivingly connected to it. As the rate of rotation is reduced, flyweights 60*a* and *b* are displaced radially inwardly thereby reducing braking until a predetermined rate of reel rotation is reached.

The embodiment of FIGS. 1-3 includes means for locking spool 18 so that a person may enter harness 21 without strap 19 immediately beginning to unwind from the spool. The preferred embodiment includes a release cable 64 which extends from a reel locking lever 66 at one end, passes through a release cable guide 68 at approximately its midpoint, with a release handle 70 being provided at the downwardly extending end. Reel locking lever 66 includes an abutment end 67 and is fixed to a reel lock mounting pin 72 which is rotatably mounted on side plate 14. A reel lock indicator 74 is also fixed to reel lock mounting pin 72 adjacent the outer side of side plate 14 to permit the operator to determine whether reel locking lever 66 is in a locked or unlocked mode. A pair of reel stops 76*a* and *b*, each of which has an inclined end 77*a* or *b* and an abutment end 78*a* or *b*, are mounted to disc 40 adjacent ring gear 42 (only the "b" components are visible in FIG. 3). Reel stops 76*a* and *b* are disposed such that when reel locking lever 66 is in its locked mode, an abutment end 78*a* or *b* of a reel stop will contact reel lock abutment end 67 to prevent rotation of disc 40 and spool 18 drivingly connected thereto.

A conventional detent mechanism (not shown) is provided at the end of reel lock indicator 74 to maintain the reel lock indicator and reel locking lever 66 in the locked mode until release cable 64 is pulled downwardly, thus shifting reel lock indicator 74 and reel locking lever 66 to the unlocked mode. In this unlocked mode, reel stop 76*a* and *b* can clear abutment end 67 of reel locking lever 66, thereby permitting free rotation of spool 18.

Strapping 19 extends downwardly between strap guides 30 and 32, which are disposed such that the strapping contacts strap guide 32, thus tending to straighten the strapping which otherwise might may have a tendency to maintain its rounded or wound condition.

A handle 79 is mounted between side plates 12 and 14 by a handle bracket 80. This permits let down apparatus 10 to be carried with relative ease.

A hanger bracket 82 is provided at the upper end of let down apparatus 10 and is mounted to hanger spacer 28 to permit the apparatus to be hung from an appropriate fixed point during let down operations.

Operation of the Embodiment of FIGS. 1-3

To use let down apparatus 10, the apparatus is first suspended by hanger bracket 82 from an appropriate support (not shown) extending out from a window or roof top. Before entering harness 21, the user shifts reel lock indicator 74 to its locked mode, thereby shifting abutment end 67 of reel locking lever 66 into position to engage reel stop 76*a* or *b*. When the user is ready to descend, handle 70 is pulled downwardly by the user or by someone else, thereby pivoting reel lock indicator 74 and reel locking lever 66 from their locked modes depicted in FIG. 3. This causes reel lock abutment end 67 to pivot, freeing reel stops 76*a* or *b* to permit spool 18 to rotate, thereby causing the user to descend.

When descent is initiated and the rate of descent begins to increase, so will the rate of rotation of governor drive shaft 46, and brake shoes 54*a* and *b* and flyweights 60*a* and *b* mounted to rotate with it. Centrifugal force acting upon brake shoes 54*a* and *b* increases braking. This increase is further accentuated by the operation of flyweights 60*a* and *b* which are forced outwardly, with the articulation of link arms 62*a* and *b* causing additional radially outwardly directed force on brake shoes 54*a* and *b*. This increased braking tends to slow the rate of descent which reduces braking until a predetermined rate of descent is achieved.

As spool 18 is unwound, the moment arm of strap 19 on spool 18 is shortened, thereby reducing the torque on spool shaft 36. Because braking is not simultaneously reduced, the rate of descent will gradually decrease as spool 18 is progressively unwound, so that the rate of descent is slowest as the user reaches the ground. This characteristic is highly desirable to provide a soft landing.

When the user reaches the ground, he climbs out of harness 21 and the apparatus 10 is ready for rewinding. Rewinding is accomplished by merely turning rewind crank arm 22, and this may be done by the next person to be let down. As the apparatus is being rewound, reel locking lever 66 is maintained in its unlocked mode. Reel stops 76*a* and *b* therefore will clear the abutment end 67 of reel locking lever 66. Even if reel locking lever 66 is inadvertently set in a locked mode, inclined ends 77*a* and *b* of reel stops 76*a* and *b* will knock reel locking lever 66 to its unlocked mode.

The presence of gear means 24 within apparatus 10 ensures that it will be relatively easy to rotate rewind crank arm 22, thereby permitting rewinding by children or elderly persons. Because the speed of rotation of governor drive shaft 46 is relatively slow, centrifugal force on brake shoes 54*a* and *b* and flyweights 60*a* and *b* will be minimal, thus presenting only a very minimal amount of drag upon the rewind of the apparatus. When apparatus 10 is fully rewound, reel lock indicator 74 is shifted to its locked mode, causing abutment end 67 of reel locking lever 66 to contact abutment end 78*a* or *b* of reel stop 76*a* or *b*, to prevent spool 18 from unwinding while the user is entering harness 21.

Figure 4:
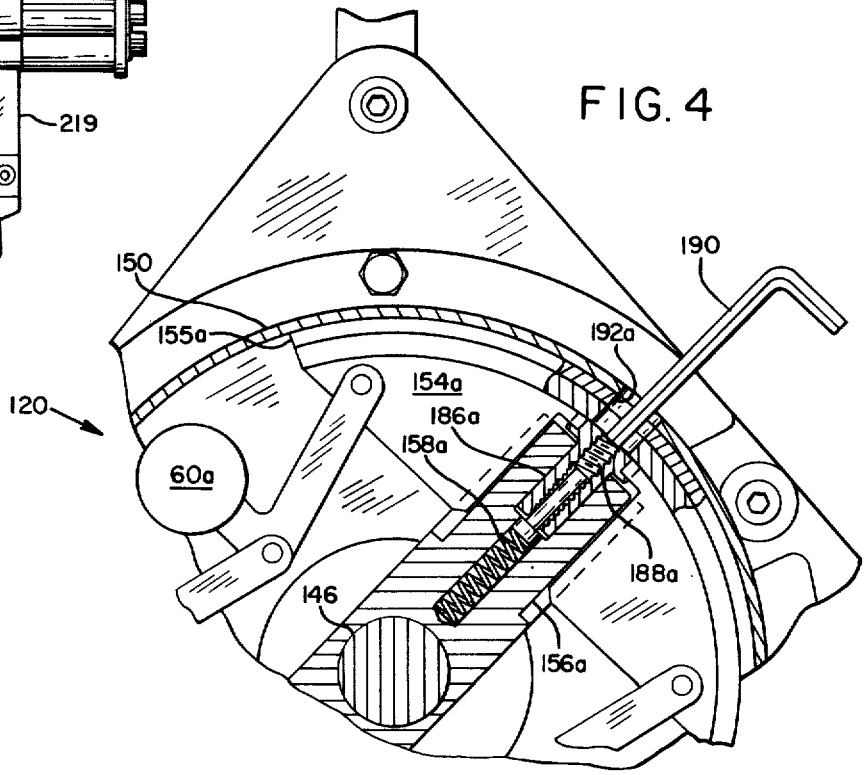
FIG. 4 is a fragmentary, cut away, side elevation view showing a modification of the governor and brake structure of the embodiment of FIGS. 1-3.

Embodiment of FIG. 4

FIG. 4 depicts a modification of the governor and brake structure 20 depicted as a part of apparatus 10 in FIGS. 1-3. The modification permits adjustment of the amount of brake pressure and therefore the rate of descent. In other respects the embodiment is identical to that described above. Therefore, corresponding components have been identified by the same numerals noted above, except they are in the 100 series. Thus, FIG. 4 depicts governor and brake structure 120, governor drive shaft 146, brake drum 150, brake shoe 154*a*, brake shoe pad 155*a*, radius arm 156*a*, and flyweights 160*a*. Because FIG. 4 is fragmentary, only the "a" components appear therein, but the "b" side of the apparatus is identical.

A pair of spring sleeves 186*a* and *b* are provided adjacent the end of each of the radius arms 156*a* and *b*. Spring sleeves 186*a* and *b* are permitted to slide in a radial direction with respect to radius arms 156*a* and *b*. A brake shoe spring 158*a* and *b* is provided in each of radius arms 156*a* and *b*, to exert a radially outwardly directed force on spring sleeves 186*a* and *b*. An Allen-type adjusting screw 188*a* or *b* is threadably engaged in each spring sleeve 186*a* and *b*. With adjusting screws 188*a* and *b* in the position depicted in FIG. 4, the pressure of brake shoe springs 158*a* and *b* will be minimal. To increase the spring pressure and therefore slow the rate of descent, adjusting screw 188*a* and *b* is screwed downwardly against brake shoe springs 158*a* and *b* using an Allen wrench 190 which is directed through aligned openings 192*a* and *b* in brake drum 150, brake shoes 154*a* and *b*, and brake pads 155*a* and *b*.

This embodiment thus provides means for varying the rate of descent of the user because it varies the amount of brake force exerted independent of the rate of descent.

It should be appreciated that brake shoe springs 158*a* and *b* and spring sleeves 186*a* and *b* may be provided regardless of whether adjustment means is included. Inclusion of the springs and sleeves would result in a slower rate of descent because a predetermined residual amount of braking force would be provided at all times regardless of the rate of descent.

Figure 6:
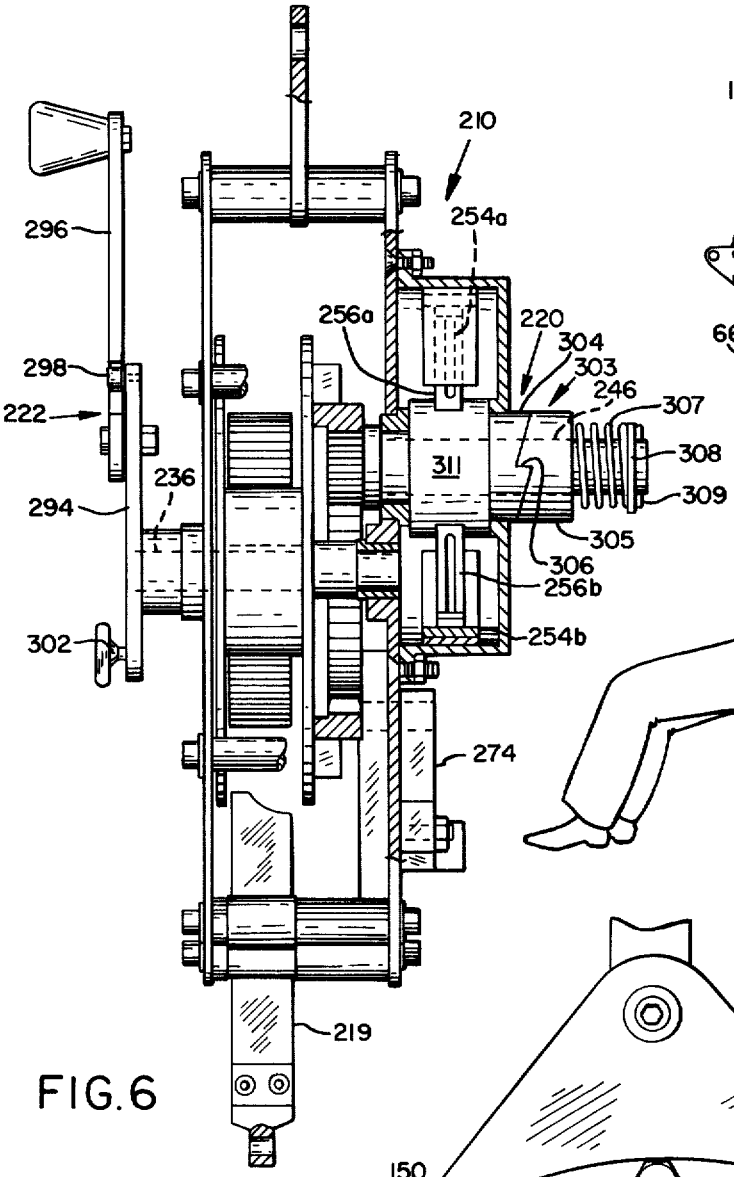
FIG. 6 is a sectional view taken along line 6—6 of FIG. 5.

Embodiment of FIGS. 5 and 6

The embodiment of FIGS. 5 and 6, utilizing the 200 and 300 series of identification numerals, is indicated generally with the numeral 210. The design of apparatus 210 is basically the same as that of apparatus 10 depicted in FIGS. 1-3 except that rewind crank arm 222 is mounted directly to spool shaft 236 rather than to governor drive shaft 246, and spool shaft 236 is rotatably mounted between the side plates. This may be desirable in instances where rewind speed is to be maximized, such as where longer lengths of strap 219 are utilized.

Rewind crank arm 222 is of compound construction, including a fixed portion 294 and a pivotal portion 296. A crank stop peg 298 is provided adjacent one end of fixed portion 294 so that when crank arm 222 is rotated in a clockwise direction as depicted in FIG. 5, pivotal portion 296 abuts crank stop peg 298 to cause rotation of fixed portion 294 and spool shaft 236. By permitting an extension of crank arm 222, this design minimizes the force required to rewind strap 219.

When strap 219 is fully rewound, pivotal portion 296 is shifted in a counterclockwise direction to its stowed position with a slot 300 engaging a thumb screw 302 adjacent the end of fixed portion 294. Thumb screw 302 is then screwed down, reel lock indicator 274 is shifting to the locked mode, and apparatus 210 is ready to receive the user.

Because the mounting of rewind crank arm 222 to spool shaft 236 permits more rapid rewind, centrifugal forces acting upon brake shoes 254*a* and *b* and the flyweights (not shown) might result in substantial braking forces being effected during rewind. Therefore, it is often desirable to include a ratchet mechanism as a part of governor brake structure 220 in apparatus 210. The ratchet structure, indicated generally at 303, is mounted to the remote end of governor drive shaft 246 and includes first and second ratchet halves 304 and 305 with meshing teeth 306, a ratchet spring 307, a spring retaining washer 308, and a spring retaining pin 309.

In this embodiment radius arms 256*a* and *b* extend from a hub 311 which is freely rotatable with respect to governor drive shaft 246. First ratchet half 304 is affixed to and adapted to rotate with hub 311. Second ratchet half 305 is keyed or otherwise fixed to governor drive shaft 246 so that during rewinding operations when the second ratchet half is rotated upwardly as depicted in FIG. 6, it intermittently compresses ratchet spring 307 as it rides over the incline lands of teeth 306. Thus, during rewind, the only rotatable portions of governor and brake structure 220 being rotated are governor drive shaft 246 and second ratchet half 305. During let down operations when second ratchet half 305 is rotated downwardly as depicted in FIG. 6, teeth 306 in first ratchet half 304 are engaged, thereby causing rotation of hub 311, radius arms 256*a* and *b* and the connected structure. Thus, during let down, braking is effected in a manner identical to that of apparatus 10.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

We claim:

1. An apparatus for letting a person down from a substantial height comprising:

a casing;

reel means rotatably mounted to said casing for storing an elongate extension member adapted to be connected to the person to be let down;

brake means for reducing the rate of rotation of said reel means, said brake means including a stationary brake drum and a pair of radially opposed brake shoes mounted to rotate with the rotation of said reel means;

governor means including a pair of radially inwardly articulated flyweights extending between said brake shoes, the articulation permitting said flyweights to be displaced radially outwardly as the rate of rotation of said brake shoes and said reel means increase to displace said brake shoes radially outwardly, whereby the pressure of said brake shoes against said brake drum and the resulting braking is increased as the rate of rotation of said reel means increases;

crank means cooperable with said reel means for permitting the elongate extension member to be rewound onto said reel means;

said brake means including radial arm means associated with each said brake shoe to stabilize said brake shoe when it contacts said brake drum and prevent other than radial movement of said brake shoe, while permitting said brake shoe to move radially toward and away from said brake drum;

said pair of articulated flyweights each having opposite ends connected to said brake shoes, the ends of the one said articulated flyweight being connected to said brake shoes on a side opposite of and equidistant from the radial arm means as the ends of the other said articulated flyweight; and lever actuated stop means for maintaining said reel means in a wound condition even after the elongate extension member is loaded, said stop means comprising a stop mounted to rotate with said reel means and having an inclined end and abutment end, and lever means pivotally mounted to said casing for engaging the abutment end of said stop to permit said stop to be selectively released and said reel means to be unwound under load, said lever means cooperating with the inclined end of said stop to permit said reel means to be rewound without disengaging said lever means from said stop.

2. The let down apparatus of claim 1, wherein said brake means includes ratchet means for causing said brake shoes to rotate only when said reel means is being unwound.

3. The let down apparatus of claim 2 wherein said crank means includes a pivotal hand crank having a portion which is extensible for rewinding said reel, and is retractable for let down.

4. An apparatus for letting a person down from a substantial height comprising:

a casing;

reel means rotatably mounted to said casing for storing an elongate extension member adapted to be connected to the person to be let down;

brake means for reducing the rate of rotation of said reel means, said brake means including a stationary brake drum and a pair of radially opposed brake shoes mounted to rotate with the rotation of said reel means;

governor means including a pair of radially inwardly articulated flyweights extending between said brake shoes, the articulation permitting said flyweights to be displaced radially outwardly as the rate of rotation of said brake shoes and said reel means increase to displace said brake shoes radially outwardly, whereby the pressure of said brake shoes against said brake drum and the resulting braking is increased as the rate of rotation of said reel means increases; and crank means cooperable with said reel means for permitting the elongate extension member to be rewound onto said reel means;

said brake means including radial arm means associated with each said brake shoe to stabilize said brake shoe when it contacts said brake drum and prevent other than radial movement of said brake shoe, while permitting said brake shoe to move radially toward and away from said brake drum;

said pair of articulated flyweights each having opposite ends connected to said brake shoes, the ends of the one said articulated flyweight being connected to said brake shoes on a side opposite of and equidistant from the radial arm means as the ends of the other said articulated flyweight;

said brake means comprising a radial member extending between said brake shoes and having braking adjustment means mounted thereto comprising spring means with threaded adjustment means to permit variation of the pressure of said brake shoes against said brake drum.

5. The apparatus of claim 4 wherein said reel means is substantially enclosed within a reel housing, and said brake means is housed within a brake housing mounted to the exterior of said reel housing.

6. The apparatus of claim 4, further comprising guide means mounted to said casing and disposed substantially below the axis of rotation of said reel means, for guiding the elongate extension member and for reducing the residual wound condition, of the member.

7. The apparatus of claim 4, further comprising an elongate extension means mounted to said reel means, and harness means mounted to the remote end of said elongate extension means, said elongate extension means including a nonconducting tape having a width substantially equal to that of said reel means.

8. The apparatus of claim 4, further comprising gear means disposed between said reel means and said brake means, said gear means including a first gear mounted to rotate with said reel means, and a second gear driven by said first gear to rotate on a second axis of rotation radially offset with respect to the axis of rotation of said reel means.

9. The apparatus of claim 8 wherein said first gear comprises an internal spur gear mounted to said reel means, and said second gear comprises a spur pinion mounted to said brake means.

10. The apparatus of claim 8 wherein said casing comprises:

a reel housing for housing said reel means and said gear means; and a brake housing mounted to one side of said reel housing for housing said brake means.

11. The apparatus of claim 10 wherein said reel housing includes a pair of side plates mounted to each other by a plurality of spacers extending therebetween, at least one of said spacers comprising guide means disposed below said first axis of rotation for guiding the elongate extension member and for reducing the residual wound condition of the member.

* * * * *